US010682784B1

(12) United States Patent
Anderson

(10) Patent No.: US 10,682,784 B1
(45) Date of Patent: Jun. 16, 2020

(54) ROUGH LUMBER KNIFE PLANER

(71) Applicant: Timesavers, LLC, Maple Grove, MN (US)

(72) Inventor: Thomas M. Anderson, Plymouth, MN (US)

(73) Assignee: Timesavers, Inc., Maple Grove, MN (US)

( * ) Notice: Subject to any disclaimer, the term of this patent is extended or adjusted under 35 U.S.C. 154(b) by 568 days.

(21) Appl. No.: 14/642,118

(22) Filed: Mar. 9, 2015

Related U.S. Application Data

(60) Provisional application No. 61/949,753, filed on Mar. 7, 2014.

(51) Int. Cl.
*B27C 1/12* (2006.01)

(52) U.S. Cl.
CPC ..... *B27C 1/12* (2013.01)

(58) Field of Classification Search
CPC B27C 1/00; B27C 1/005; B27C 1/007; B27C 1/02; B27C 1/04; B27C 1/06; B27C 1/08; B27C 1/12
USPC ..... 144/114.1, 242.1, 243, 244, 250.12, 144/250.18, 250.19, 250.2, 250.26
See application file for complete search history.

(56) References Cited

U.S. PATENT DOCUMENTS 182,685 A * 9/1876 Mahon ..... B23C 1/027 409/206
2,102,186 A * 12/1937 Nicholson ..... B27C 1/08 144/114.1
2,326,076 A * 8/1943 Solem ..... B27B 25/02 144/250.1
2,738,813 A * 3/1956 Pritchard ..... B27C 1/08 144/36
2,771,104 A * 11/1956 Saxe ..... B27C 1/10 144/114.1
2,819,744 A * 1/1958 Chuet ..... B27C 1/12 144/116
2,969,816 A * 1/1961 Johnsa ..... B27C 1/02 144/117.1
4,356,045 A * 10/1982 Elford ..... B27M 3/0086 144/136.1
4,394,878 A * 7/1983 Rice ..... B27C 1/04 144/117.1
4,438,795 A * 3/1984 Plough ..... B23Q 1/28 144/116
4,457,350 A * 7/1984 Finnila ..... B27B 25/02 144/117.1

(Continued)

*Primary Examiner* — Shelley M Self
*Assistant Examiner* — Smith Oberto Bapthelus
(74) *Attorney, Agent, or Firm* — Dicke, Billig & Czaja, PLLC

(57) ABSTRACT

A planing machine (or simply "planer") which may have two planer heads, each head containing the conventional knives and supporting apparatus to perform the actual cutting of material. To improve yield, the board is centered vertically as it progresses longitudinally through the planer. This is accomplished using either or (preferably) both of two systems: (1) a segmented self-centering drive roll system to feed the boards into the machine; and (2) a shoe mechanism which is controlled by a linkage such that the retracting segmented shoe assembly moves away from the planer head as it moves vertically to compensate for varying material thicknesses. The result is a more efficient use of the workpiece because less waste is created.

11 Claims, 8 Drawing Sheets

(56) References Cited

U.S. PATENT DOCUMENTS

| | | | | | |
|---|---|---|---|---|---|
| 4,611,646 | A * | 9/1986 | Wassmer | B27C 1/08 | 144/117.1 |
| 4,724,877 | A * | 2/1988 | Culley, Jr. | B27B 25/02 | 144/116 |
| 4,993,464 | A * | 2/1991 | Englert | B27G 21/00 | 144/136.1 |
| 5,368,077 | A * | 11/1994 | Croghan | B23Q 1/70 | 144/114.1 |
| 6,296,029 | B1 * | 10/2001 | Grivna | B27C 1/12 | 144/115 |
| 6,561,239 | B2 * | 5/2003 | Englert | B23Q 17/12 | 144/114.1 |
| 6,705,455 | B2 * | 3/2004 | Lin | B27B 25/02 | 144/246.1 |
| 7,490,641 | B2 * | 2/2009 | McGehee | B27C 1/08 | 144/117.1 |
| 7,971,612 | B2 * | 7/2011 | Lapointe | B27C 1/08 | 144/117.1 |
| 8,360,120 | B2 * | 1/2013 | Chuang | B27C 1/12 | 144/114.1 |
| 9,248,516 | B2 * | 2/2016 | Shirk | B27C 1/12 | |
| 2009/0260718 | A1 * | 10/2009 | Wang | B27C 1/04 | 144/230 |
| 2012/0132319 | A1 * | 5/2012 | Chuang | B27C 1/04 | 144/130 |

* cited by examiner

ROUGH LUMBER KNIFE PLANER

TECHNICAL FIELD

This invention relates to machinery for finishing rough surfaces of lumber that pass through the machinery, and particularly to such machines that plane opposite faces of rough-cut lumber.

BACKGROUND

The basic features of rough lumber planers are well known. In general, a feed mechanism carries a workpiece between a series of knives that remove small portions of wood from both upper-facing and lower-facing surfaces of the wood.

SUMMARY

In general terms, a planing machine (or simply "planer") built according to the principles of the invention provides the best possible yield when planing rough lumber. Such a machine may have two planer heads, each head containing the conventional knives and supporting apparatus to perform the actual cutting of material. One head is for removing material from the top of the board, and the other is for removing material from the bottom of the board. To improve yield, the board is centered vertically as it progresses longitudinally through the planer. This is accomplished using either or (preferably) both of two systems: (1) a segmented self-centering drive roll system to feed the boards into the machine; and (2) a shoe mechanism which is controlled by a linkage such that the retracting segmented shoe assembly moves away from the planer head as it moves vertically to compensate for varying material thicknesses.

In preferred embodiments, the planing machine is an assembly for planing rough surfaces of a piece of wood, comprising: (a) a pair of planer heads positioned to remove material from opposing rough surfaces of the piece of wood; (b) a segmented self-centering drive roll system which feeds a leading edge of the piece of wood toward, and vertically centered between, the pair of planer heads (the leading edge being fed over a longitudinal gap between the drive roll system and the planer heads); and (c) at least one pair of sets of movable shoe subassemblies.

The basic concept is that two or four opposed drive roller assemblies (top and bottom) center, grip, and push the lumber through two opposed shoe assemblies (top and bottom) that further center and guide the lumber between two planer cutterhead assemblies (top and bottom) that remove equal amounts of wood from both sides of the lumber at the same time. Furthermore, both roller and shoe assemblies have multiple components (rollers and shoes) so that two or more boards of unequal thickness can be planed at the same time and still be centered properly to remove equal amounts of wood from both sides of both (or multiple) boards.

In preferred embodiments, the drive roll system comprises individual drive wheels mounted along a shaft. Such shafts and wheels are provided in pairs, one member of the pair positioned above or on top of the rough lumber, the other directly opposed to the first on the bottom of the lumber. There may be multiple pairs of such wheels, spaced longitudinally along the direction of travel of the lumber. The preferred construction of each drive wheel is a steel core, a resilient material surrounding the steel core, and a knurled rim surrounding the resilient material. In another preferred embodiment, the drive roll system comprises four feed roll assemblies rotationally driven in pairs, having opposing directions of motion relative to the piece of wood.

In other preferred embodiments, each member of the pair of movable shoe subassemblies comprises a vertically movable shaft and a shoe pivotably mounted to one end of the shaft such that the shoe is in the longitudinal gap. The shoe vertically holds the leading edge of the board despite vertical movement of the shaft. The shoe is mounted by each of a set of two linkages to a fixed mount. The linkages are not parallel to each other, so that the shoe moves away from the planer heads as it moves vertically. In preferred, but not required embodiments, the shoe has a lower surface facing the surface of the board, and the lower surface of the shoe comprises multiple stages. This allows the shoe to accommodate boards of varying thicknesses at varying amounts of insertion into the gap. Other variations include reciprocal vertical motion of the shoe, which can be accomplished by a spring, a pneumatic assembly (e.g., an air-filled bladder), and the like. The number of movable shoe subassemblies in each member of a pair may vary, i.e., it could be eight or ten in typical applications.

DESCRIPTION OF THE DRAWINGS

The figures are schematic and provided for illustration only, and thus do not limit the scope of the invention. In particular, common accessories and components, such a mounting hardware and electrical wiring, has been omitted solely for clarity.

DETAILED DESCRIPTION

In the description below, the longitudinal direction is direction of travel of the workpiece having its surface finished, i.e., longitudinal corresponds to "forward" or "reverse" directions of the workpiece. The transverse direction is perpendicular to longitudinal but within the plane of the workpiece, i.e., corresponding to the "width" of the throat of the apparatus into which the workpiece travels. The vertical direction is perpendicular to the plane of the workpiece, i.e., away from or toward the surface being finished (whether such surface is upward-facing or downward-facing).

In general terms, a planing machine (or simply "planer") built according to the principles of the invention is illustrated in FIGS. 1-9. It is designed to provide the best possible yield when planing rough lumber. The objective in planing is to remove sufficient material from both sides of a board to get down to the "clean" lumber, but to remove no more material than absolutely necessary. The less material removed to get to "clean" lumber, the higher the yield.

Such a machine 100 may have two planer heads, each head 110 containing the conventional knives 120 (details of which are omitted for clarity only) and supporting apparatus to perform the actual cutting of material. One head is for removing material from the top of the board, and the other is for removing material from the bottom of the board.

It is important that the board be presented to the two planer heads in such a manner that an equal amount of material is removed from the top and bottom of the board. If more material is removed from one side or the other, yield will diminish.

Often, boards being fed longitudinally into a planer are not all the same thickness. Many conventional planers remove a constant amount of material from one side of each board, and a varying amount from the second side, instead of centering the board so that equal amounts are taken from each side. A thinner board will have less material removed from the second "non-constant" side, and this often results in a "skip," or an area where inadequate material was removed to "clean up" the board.

However, it the board is centered vertically as it progresses longitudinally through the planer, the board is centered between the planer heads and equal amounts are planed from each side of every board every time.

Figure 1:
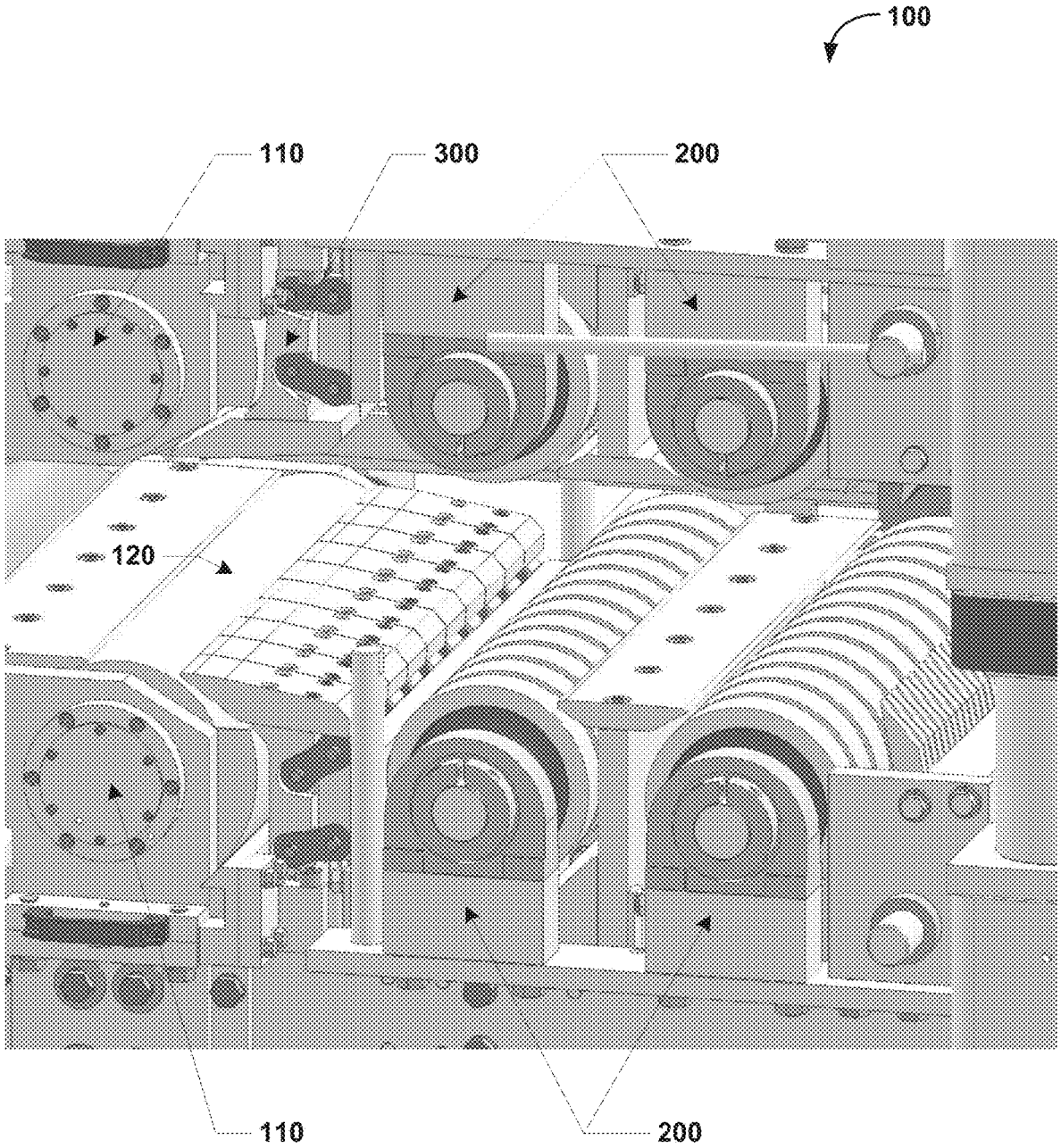
FIG. 1 is a perspective view of a portion of a planing machine (or simply "planer") built according to the principles of the invention.
Figure 2:
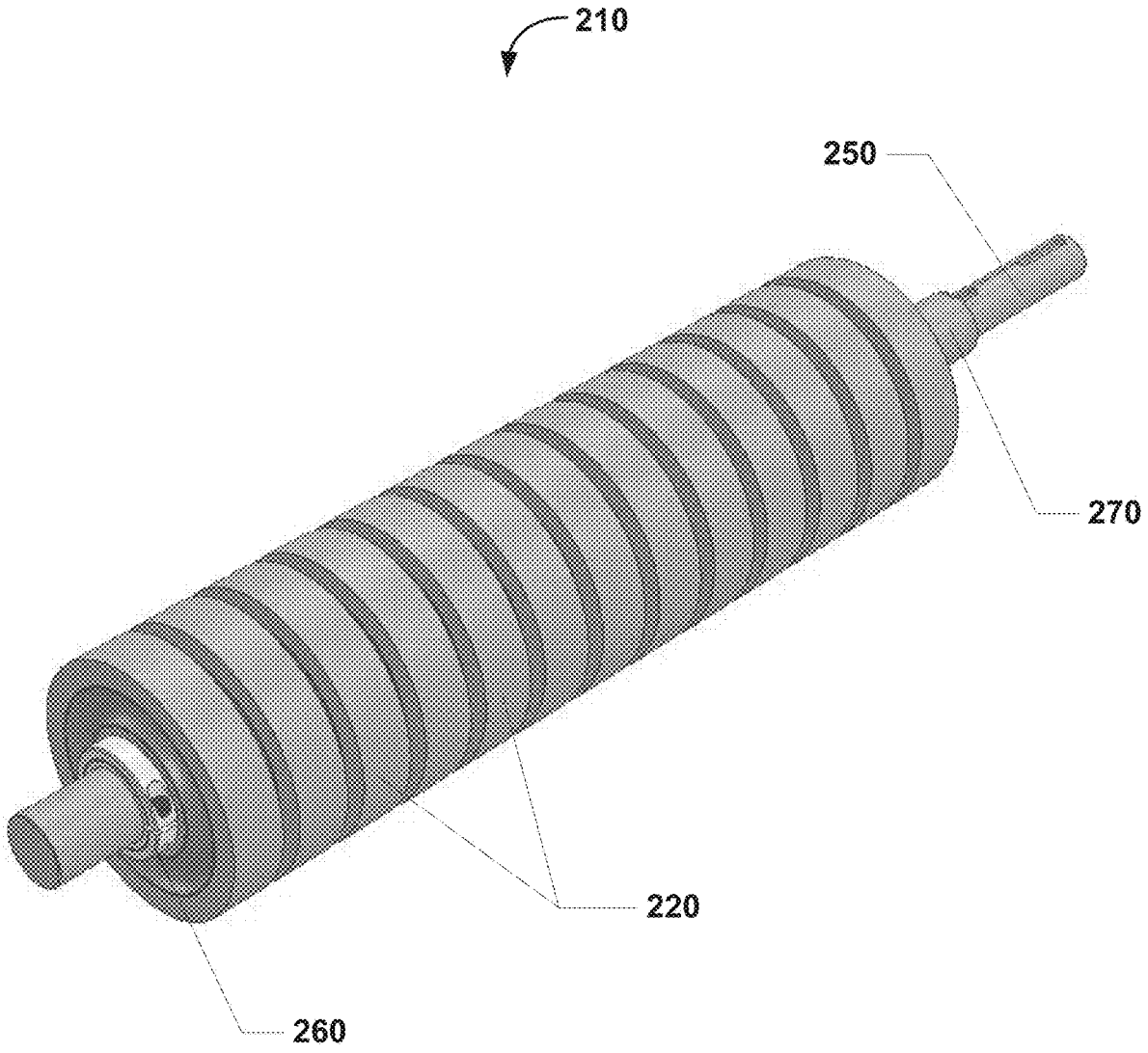
FIG. 2 is a perspective view of an embodiment of a segmented self-centering drive roller assembly.

Turning specifically to FIG. 1, a segmented self-centering drive roll system 200 feeds boards longitudinally (from right to left as illustrated in FIG. 1) toward planer heads 110. As shown in FIG. 2, the feed drive roll 210 consists of multiple individual drive wheels 220 mounted to shaft 250 and held in position by a pair of rings or collars or similar mechanism 260, 270 along shaft 250; see also FIGS. 4 and 5, in which all but one drive wheel 220 have been omitted for clarity.

Figure 3:
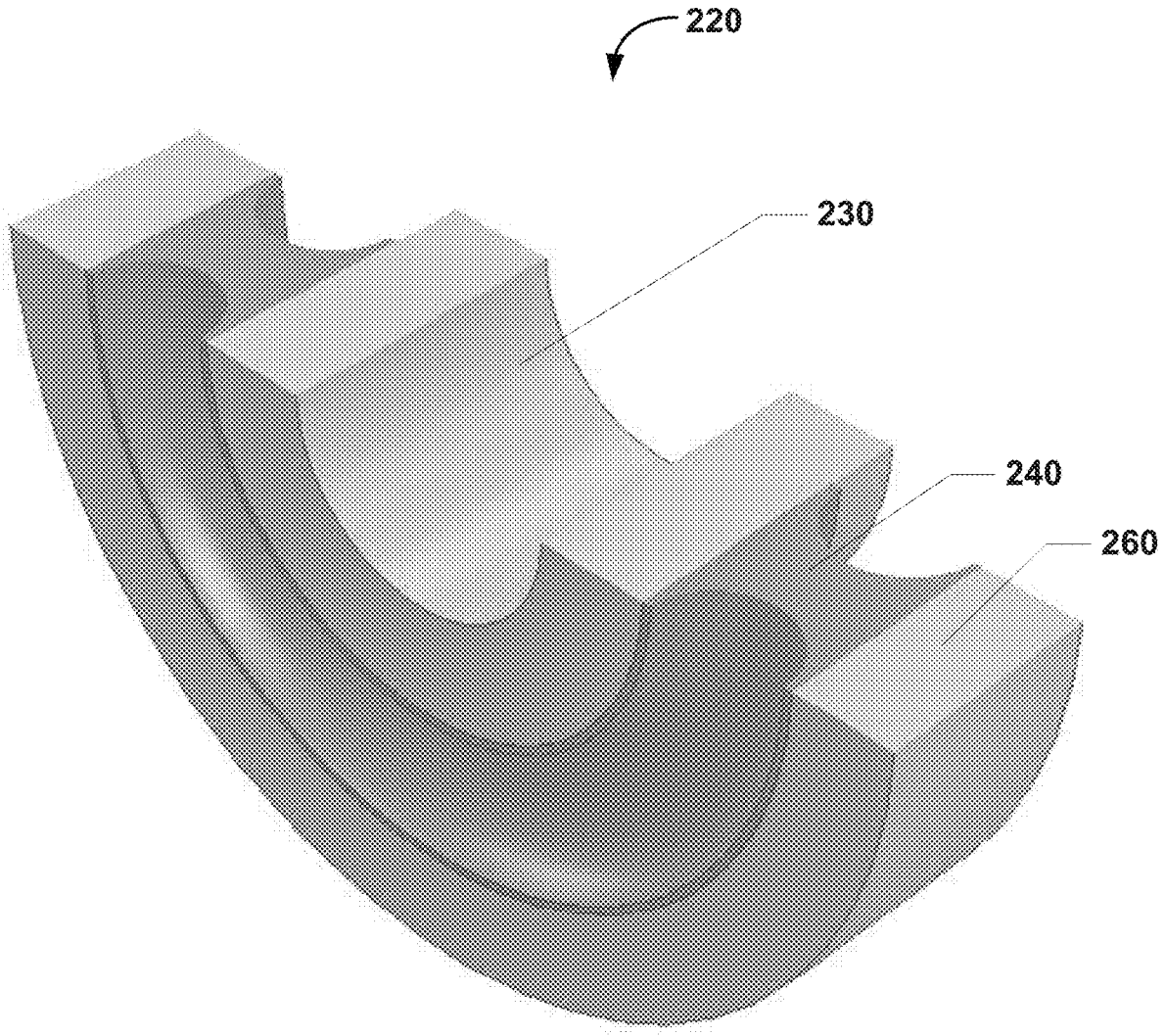
FIG. 3 is a cross-sectional view of one roller of the assembly of FIG. 2.
Figure 4:
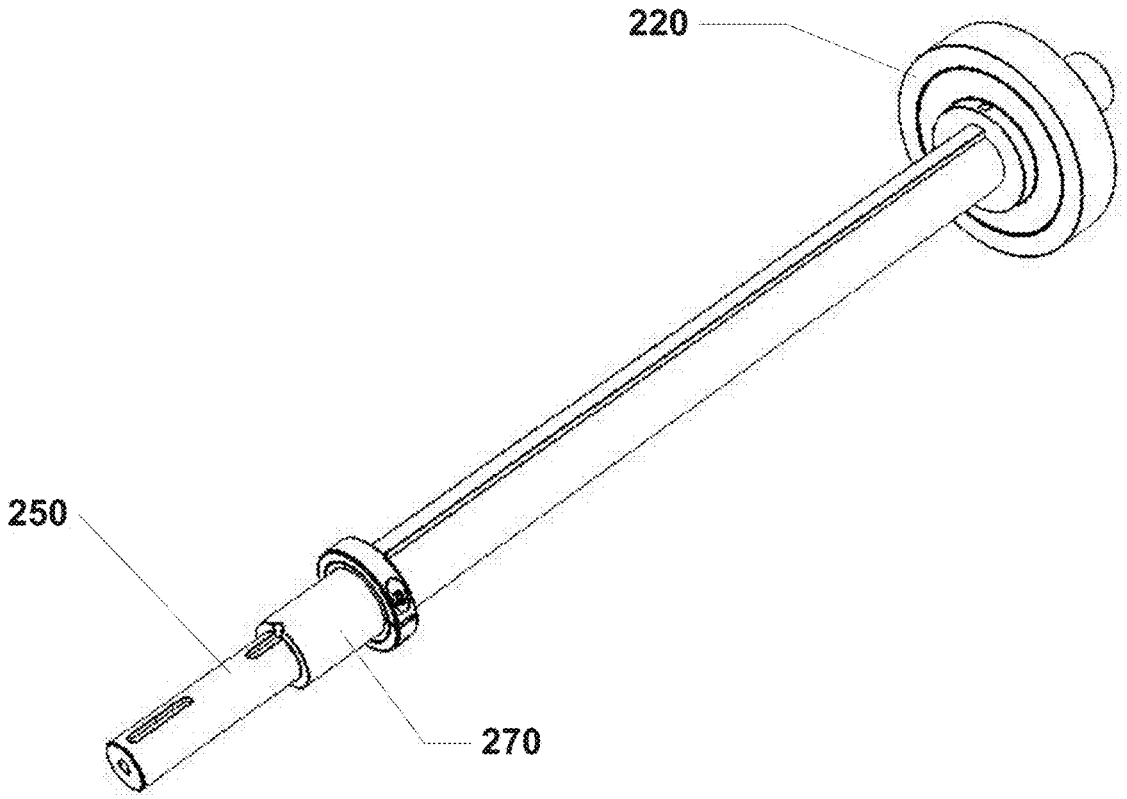
FIGS. 4 and 5 are a pair of reversed perspective views of the assembly of FIG. 2 in which all but a single roller has been removed for purposes of illustration only.
Figure 5:
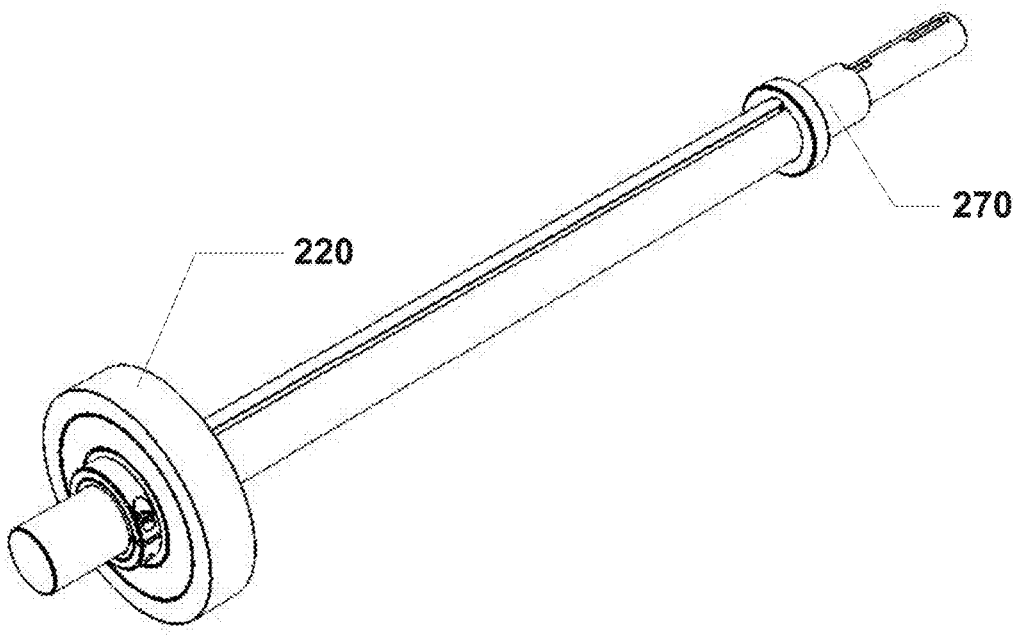

As illustrated in the cross-sectional view of FIG. 3, in the preferred embodiment, each feed drive wheel 220 comprises a 3 7/16 inch diameter steel core 230 surrounded by a 1-inch thick layer of rubber 240, which in turn is surrounded by an 11/16 inch thick knurled steel rim 260. (The knurling is omitted for clarity only.) Each of the individual drive wheels or segments 220 is preferably 1½ inches wide; the thirteen illustrated in FIG. 2 produce a total working width on the order of twenty to twenty-four inches (due in part to small gaps between immediately adjacent wheels 220, as shown). Such dimensions are only examples, and not limitations on the scope of the invention.

Returning to FIG. 1, in the preferred embodiment, four individual feed roll assemblies 200 are driven by motors (not shown), with the direction of rotation of the two rolls on the top and two rolls on the bottom directly opposed to each other (e.g., the upper pair rotate clockwise and the lower pair rotate counterclockwise). Boards are fed into the machine between the pairs of opposing feed rolls. As rough lumber is fed into the machine, the rubber core 240 (FIG. 3) compresses to compensate for the different thicknesses of lumber. Equal pressure is imparted to both the top and the bottom of the board, resulting in the board being centered as it is presented to the planer heads 110.

FIG. 1 also illustrates a pair of assemblies of retracting segmented shoes 300. Such assemblies may, but need not be, used in a single planer machine with the segmented self-centering drive roll system of FIGS. 2-5. The physical geometry of orienting a cylindrical drive roller 200 in front of a cylindrical planer head 120 results in a gap between the two. Void of any other hardware, a board that is introduced to the cutter head 120 would be unsupported in this area and consequently would be unconstrained from moving up or down as the end of the board enters this area. This instability of the board as it enters the space between the feed mechanism considering FIGS. 6-8, and the planer heads will result in more material being removed from one side of the board. The resulting uneven cut on the end of the board is referred to as "snipe."

To minimize snipe, a shoe mechanism 300 is used to hold the board as close to the planer head as possible. The function of the shoe mechanism is to help center the board between the two opposing planer heads. A typical shoe design will move only vertically (up or down) away from the center of the board when different thickness material is presented to the planer head. The trouble is that as a shoe moves away from the centerline of the material, it will move into the space occupied by the planer head, destroying both the planer head and the shoe assembly. In order for a typical shoe arrangement to work in this configuration, the shoe assembly must be placed at some distance away from the planer head to allow for safe refraction of the shoe. The additional spacing away from the cutter results in poor support of the material as it approaches the planer head.

Figure 6:
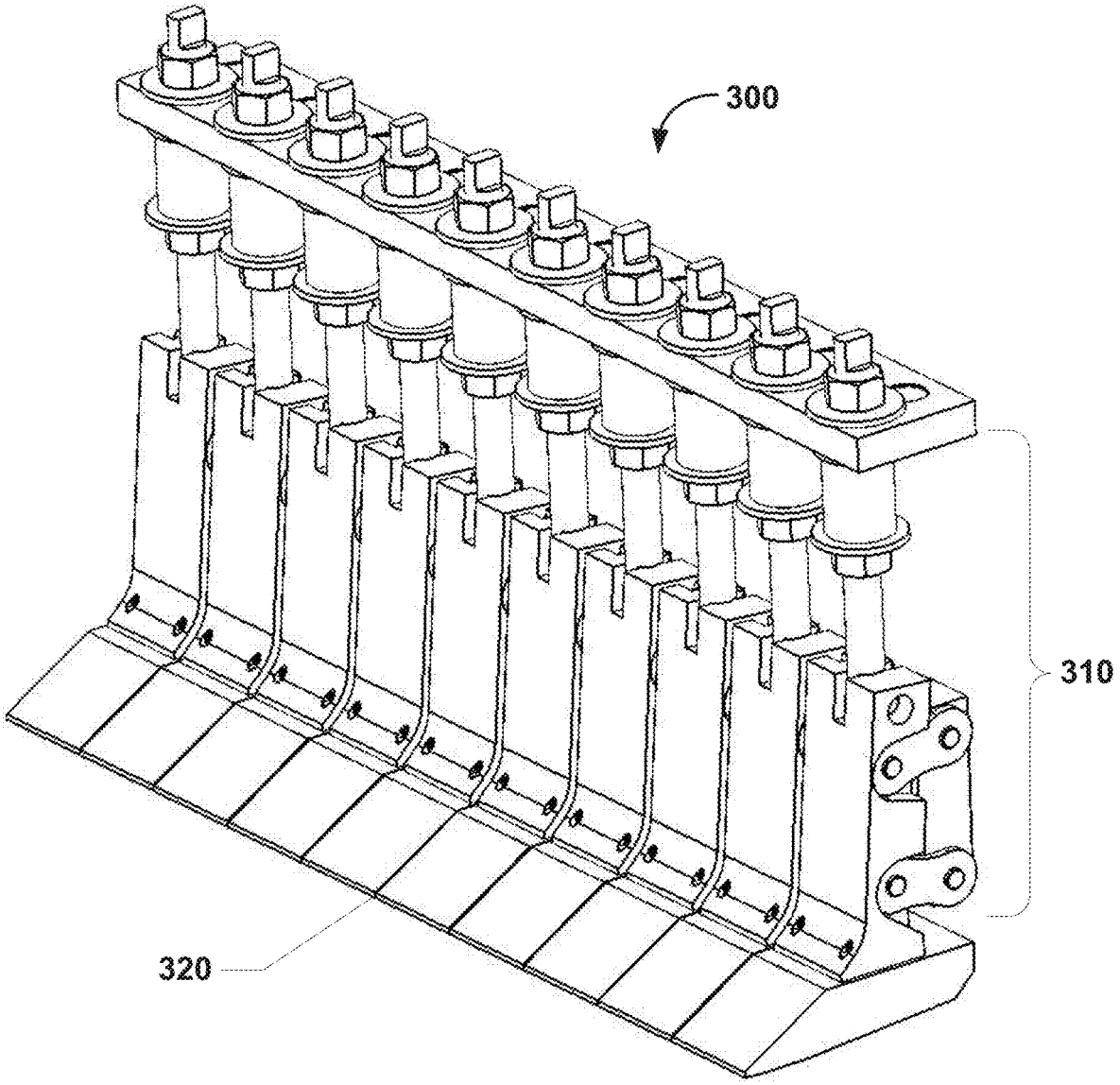
FIG. 6 is a perspective view of an embodiment of a retractable segmented shoe assembly.
Figure 7:
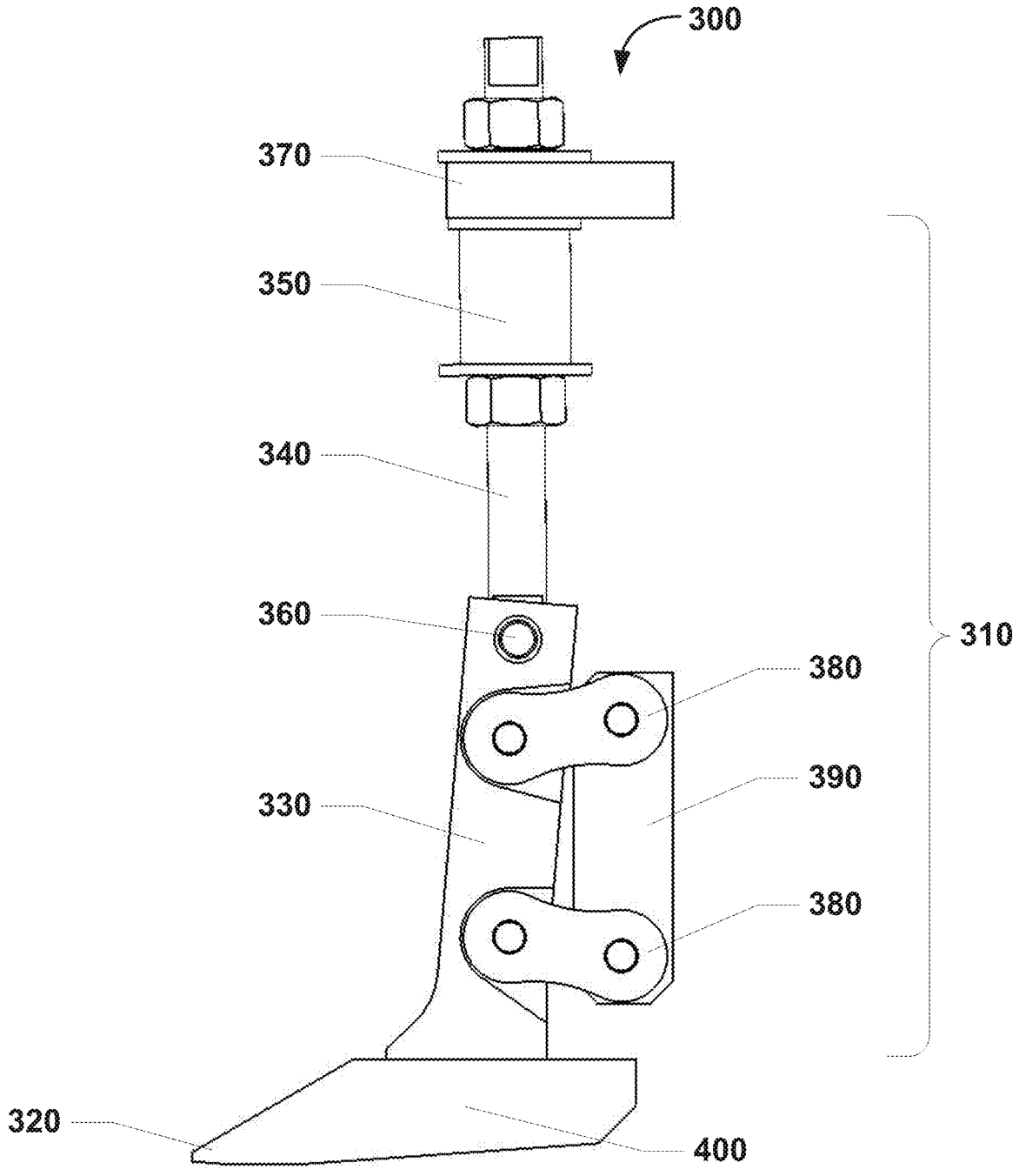
FIG. 7 is a close-up side view of one component of the assembly of FIG. 6.
Figure 8:
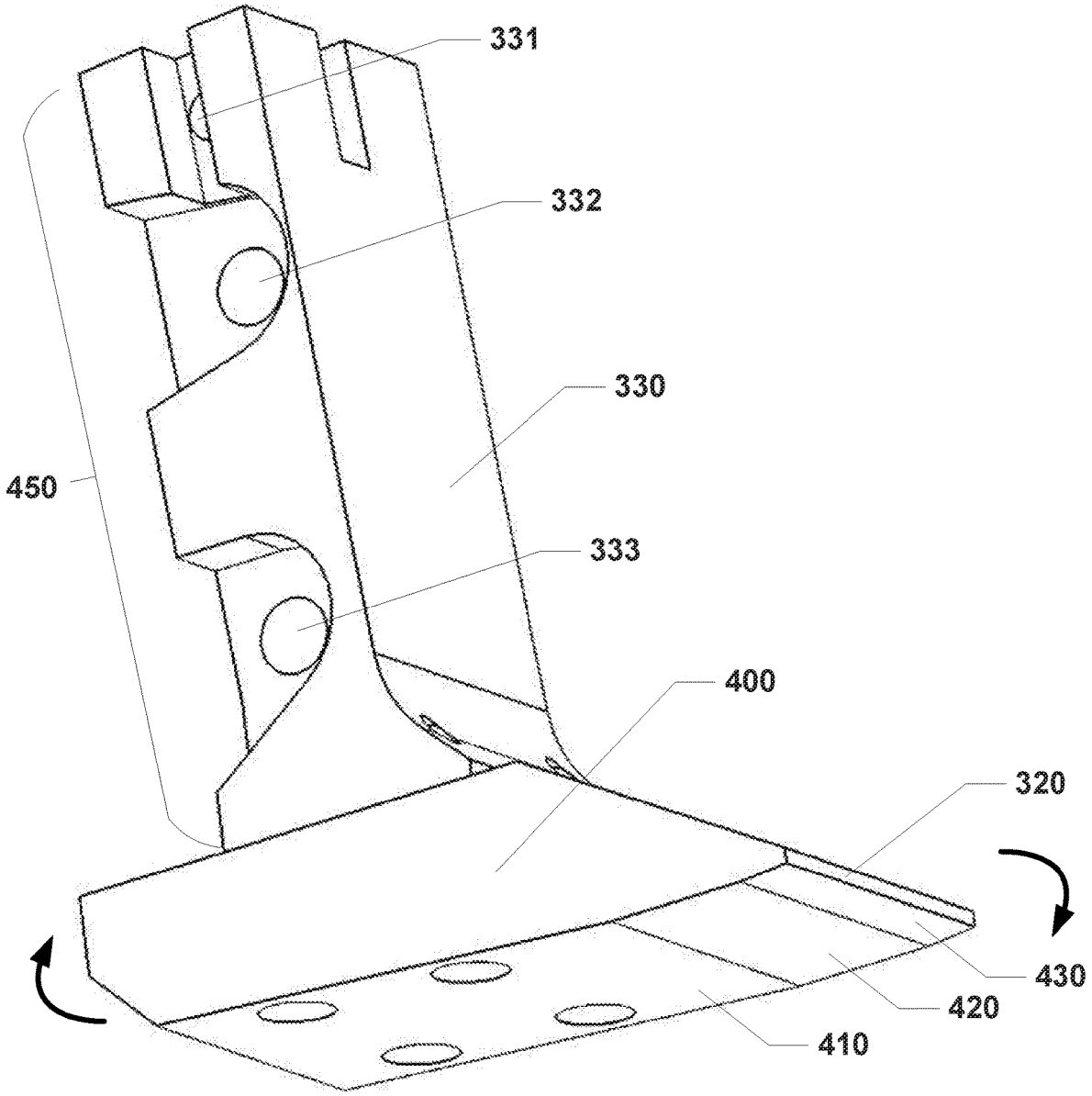
FIG. 8 is a reversed lower perspective view of selected components of the assembly of FIGS. 6-7.

The unique feature of the retracting segmented shoe assembly 300 is that it moves away from the planer head as it moves vertically to compensate for varying material thicknesses. Turning to FIGS. 6-8, the vertical motion of the shoe 330 is controlled by a set of linkages 310. The geometry of the linkage defines the path that the shoe 330 follows as it moves away from the centerline of the material. The distance between the tip 320 of the lower portion of the shoe 330 and the planer head 120 is maintained at a very narrow dimension. As a result, this retracting segmented shoe assembly can be placed much closer to the planer head than with a traditional shoe design. As a direct result of being able to hold the material closer to the planer head, the material is kept at equal distance from the two planer heads regardless of the thickness of the board. The number of shoes 330 is not critical; in FIG. 6 there are ten shoes 330 illustrated, but this number could be increased or decreased depending on the circumstances.

Specifically, upper portion 450 of shoe 330 is pivotably mounted at 331 to the end of vertical shaft 340 (for example, by a cotter pin 360) at a slight angle from true vertical. Spring 350 (the spring windings are omitted for clarity only) provides for reciprocating, vertical motion of shaft 340, and thus shoe 330, with respect to the upper fixed mount 370. (The bottom of the shaft moves slightly as the shoe top rotates.) Upper and lower links 380 couple moving shoe 330 at 332, 333 to lower fixed mount 390, and are arranged to be not parallel with each other. This, and the slight angle from true vertical of shoe 330 combine to keep the tip 320 of shoe 330 close to planer head 120 as mentioned above.

As shown in more detail in FIG. 8, the lower surface of lower portion 400 is a series of stages 410, 420, and 430 so that the motion of shoe 330 will support the board as well as possible at different board thicknesses. Returning also to FIG. 1, it may be seen that relatively thinner board thicknesses will approach the planer head 120 and contact only stage 410, while relatively thicker boards will move shoe 330 vertically and laterally backward away from the planer head 120 (due to linkage system 310), which in turn forces the board to contact stages 420 and 430 as the board thickness increases. As indicated by the arrows in FIG. 8, as the thickness of the lumber increases, the shoes retract and tilt.

An alternative to use of a wound spring 350 on each shoe is a pneumatic assembly. One possible such assembly is illustrated schematically in FIG. 9. In this possible embodiment, the pneumatic assembly 500 includes an air-filled bladder 510 clamped at each of its ends 511, 512 by a clamp or similar device, illustrated in FIG. 9 as pairs of plates 515 and 516, respectively. The clamps prevent air leakage after bladder 510 has been inflated. Of course, if bladder 510 is inherently closed at end 512, the clamp (i.e., as illustrated, plates 516) may be omitted; however, this may require a heavier material for bladder 510 than would otherwise be necessary or cost-effective compared to the use of a clamp. A connection 513 is provided to connect bladder 510 to a supply of compressed air and pressure regulator (not shown) to inflate bladder 510 and maintain adequate air pressure in bladder 510. Thus, the pressure may be adjusted and maintained remotely from the assembly, which is what makes this embodiment preferred over others.

Bladder 510 may be held in position underneath fixed upper plate 520 by one or more brackets 530. Fixed upper plate 520 is analogous to fixed upper mount 370 (see FIG. 6), except that it need not have holes to allow passage of shaft 340 through itself. Instead, the upper end of each shaft 340 supports an upward-facing lower plate 550, which compresses bladder 510 when each shoe assembly 300 moves upward. Thus, a single pneumatic assembly 500 replaces a set of multiple springs 350 in the earlier embodiment, but with a desirable reduction in the number of parts required.

In general, there need only be an assembly which provides the resilience required for sufficient reciprocating, vertical motion of shaft 340 as described above. Such an assembly could be based on mechanical principles (an example of which is spring 350), pneumatic principles (as just described with respect to pneumatic assembly 500), or other principles producing the same result.

Figure 9:
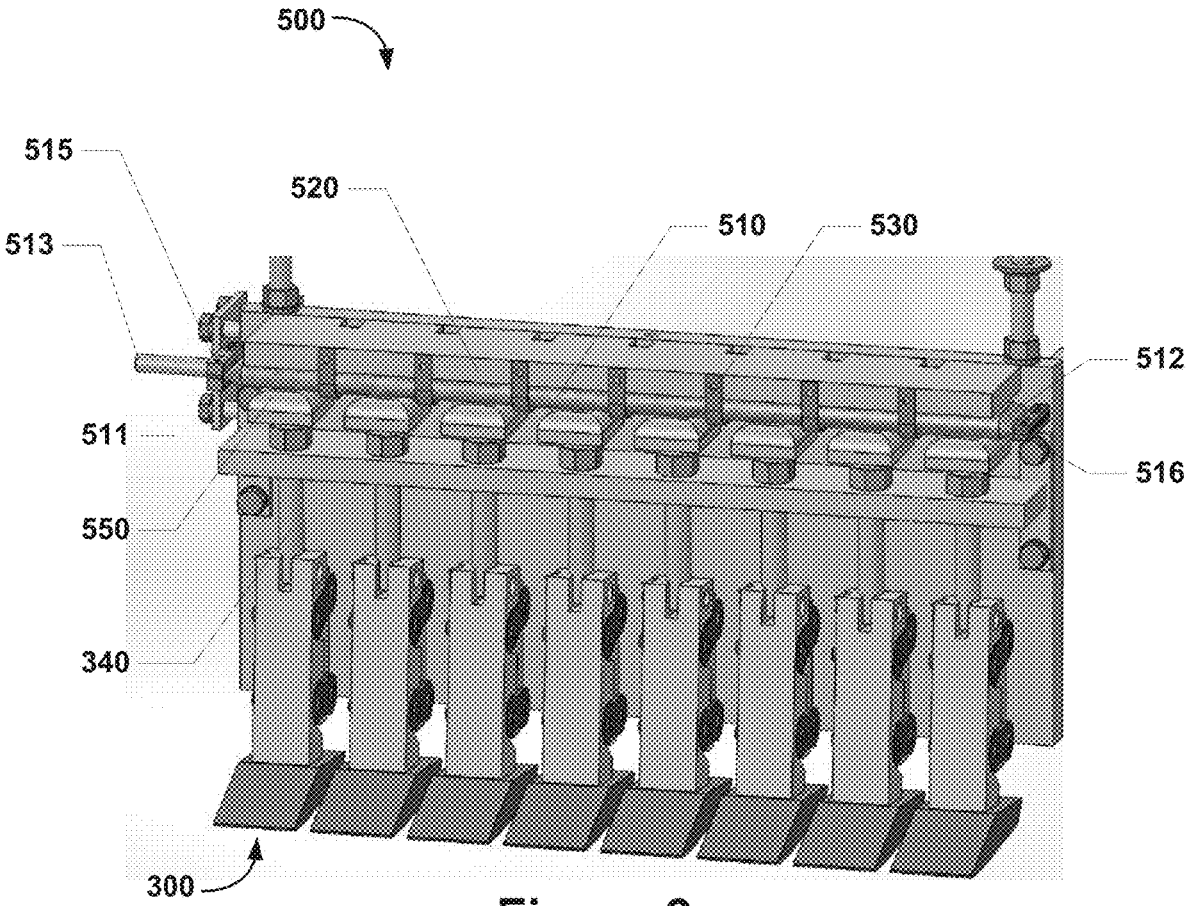
FIG. 9 is a perspective view of selected components of an embodiment which is an alternative to the embodiment of FIG. 6.

FIG. 9 also illustrates eight shoe assemblies 300, reinforcing that the number is not critical, as noted above.

I claim:

1. An assembly for planing rough surfaces of a piece of wood, comprising:

(a) a pair of planer heads positioned to remove material from opposing rough surfaces of the piece of wood;

(b) a segmented self-centering drive roll system which feeds a leading edge of the piece of wood toward, and vertically centered between, the pair of planer heads, the leading edge being fed over a longitudinal gap between the drive roll system and the planer heads; and (c) at least one pair of movable shoe subassemblies, each shoe subassembly comprising a shoe having first, second, and third locations which are different from each other, upper and lower portions, and only one vertically movable shaft, pivotably mounted to only the first location of the shoe such that only the lower portion of the shoe is in the longitudinal gap, in which the lower portion of the shoe vertically holds the leading edge of the piece of wood despite vertical movement of the shaft causing vertical motion of the shoe, and further in which the shoe is mounted to a fixed mount at each of the second and third locations by one of a set of two linkages which are not parallel to each other, so that the lower portion of the shoe moves away from the planer heads as the upper portion of the shoe pivots about the first location and moves vertically due to the vertical motion of the shaft.

2. The assembly of claim 1, in which the lower portion of the shoe has a lower surface facing the surface of the piece of wood, the lower surface of the shoe comprising multiple stages.

3. The assembly of claim 1, in which vertical motion of the upper portion of the shoe is reciprocal.

4. The assembly of claim 3, further comprising a spring for producing the reciprocal vertical motion.

5. The assembly of claim 3, further comprising a pneumatic assembly for producing the reciprocal vertical motion.

6. The assembly of claim 5, in which the pneumatic assembly comprises an air-filled bladder.

7. The assembly of claim 1, in which there are eight movable shoe subassemblies in each member of the pair.

8. The assembly of claim 1, in which the drive roll system comprises individual drive wheels mounted along a shaft.

9. The assembly of claim 8, in which each drive wheel comprises a steel core, a resilient material surrounding the steel core, and a knurled rim surrounding the resilient material.

10. The assembly of claim 8, in which the drive roll system comprises four feed roll assemblies rotationally driven in pairs having opposing directions of motion relative to the piece of wood.

11. The assembly of claim 1, in which the upper portion of the shoe is pivotably mounted to the shaft farther away from the piece of wood than any linkage is mounted to the upper portion of the shoe.

* * * * *